US008607894B2

(12) United States Patent
McDonald et al.

(10) Patent No.: US 8,607,894 B2
(45) Date of Patent: Dec. 17, 2013

(54) OFFSHORE THERMAL TREATMENT OF DRILL CUTTINGS FED FROM A BULK TRANSFER SYSTEM

(75) Inventors: Nick McDonald, Midlothian (GB); Andrew John Murray, Moray (GB); Gordon M. Logan, Aberdeen (GB); Dan Knapper, Kinellar (GB)

(73) Assignee: M-I LLC, Houston, TX (US)

( * ) Notice: Subject to any disclaimer, the term of this patent is extended or adjusted under 35 U.S.C. 154(b) by 527 days.

(21) Appl. No.: 12/878,728

(22) Filed: Sep. 9, 2010

(65) Prior Publication Data

US 2011/0005832 A1 Jan. 13, 2011

Related U.S. Application Data

(63) Continuation-in-part of application No. 11/952,047, filed on Dec. 6, 2007, now Pat. No. 8,074,738.

(60) Provisional application No. 60/869,175, filed on Dec. 8, 2006, provisional application No. 60/951,845, filed on Jul. 25, 2007.

(51) Int. Cl.
*E21B 7/12* (2006.01)
*E21B 21/06* (2006.01)

(52) U.S. Cl.
USPC ..... 175/5; 175/66; 175/206; 175/207; 166/357; 166/358

(58) Field of Classification Search
USPC ..... 175/5, 66, 206, 207, 212, 217; 166/357, 166/358, 351, 352; 210/767, 770, 774, 775, 210/787
See application file for complete search history.

(56) References Cited

U.S. PATENT DOCUMENTS

| | | | | | |
|---|---|---|---|---|---|
| 4,595,422 | A | * | 6/1986 | Hill et al. | 134/19 |
| 5,109,933 | A | * | 5/1992 | Jackson | 175/66 |
| 5,127,343 | A | * | 7/1992 | O'Ham | 110/233 |
| 5,129,469 | A | * | 7/1992 | Jackson | 175/66 |
| 5,236,605 | A | * | 8/1993 | Warncke | 210/799 |
| 5,294,061 | A | | 3/1994 | van Dijk | |
| 5,303,786 | A | * | 4/1994 | Prestridge et al. | 175/66 |
| 5,310,285 | A | * | 5/1994 | Northcott | 588/250 |
| 5,344,570 | A | * | 9/1994 | McLachlan et al. | 210/709 |
| 5,402,857 | A | * | 4/1995 | Dietzen | 175/66 |
| 5,564,509 | A | * | 10/1996 | Dietzen | 175/66 |

(Continued)

FOREIGN PATENT DOCUMENTS

| | | |
|---|---|---|
| WO | 9008177 A1 | 7/1990 |
| WO | 02088506 A2 | 11/2002 |
| WO | 2006/003400 | 1/2006 |

OTHER PUBLICATIONS

PCT International Search Report issued in PCT Application No. PCT/US2007/086881 dated May 13, 2008 (3 pages).

(Continued)

*Primary Examiner* — Matthew Buck
(74) *Attorney, Agent, or Firm* — Osha Liang LLP

(57) ABSTRACT

A system for offshore disposal of drill cuttings including a cleaning system for treating contaminated drill cuttings into drill cuttings and contaminants; a transport system for moving the drill cuttings; a slurrification system for making a slurry of the treated drill cuttings; and a cuttings re-injection system for injecting the slurry into a well.

19 Claims, 8 Drawing Sheets

(56) References Cited

U.S. PATENT DOCUMENTS

| | | | | |
|---|---|---|---|---|
| 5,839,521 | A * | 11/1998 | Dietzen | 175/66 |
| 5,842,529 | A * | 12/1998 | Dietzen | 175/66 |
| 5,913,372 | A * | 6/1999 | Dietzen | 175/66 |
| 5,964,304 | A * | 10/1999 | Morrison et al. | 175/38 |
| 5,968,370 | A * | 10/1999 | Trim | 210/723 |
| 6,009,959 | A * | 1/2000 | Dietzen | 175/66 |
| 6,106,733 | A * | 8/2000 | Wood | 210/774 |
| 6,119,779 | A * | 9/2000 | Gipson et al. | 166/267 |
| 6,170,580 | B1 * | 1/2001 | Reddoch | 175/66 |
| 6,179,070 | B1 * | 1/2001 | Dietzen | 175/66 |
| 6,179,071 | B1 * | 1/2001 | Dietzen | 175/66 |
| 6,213,227 | B1 * | 4/2001 | Dietzen | 175/66 |
| 6,234,258 | B1 * | 5/2001 | Karigan | 175/66 |
| 6,328,118 | B1 * | 12/2001 | Karigan et al. | 175/66 |
| 6,345,672 | B1 * | 2/2002 | Dietzen | 175/66 |
| 6,391,198 | B1 * | 5/2002 | Porter et al. | 210/241 |
| 6,553,901 | B2 * | 4/2003 | Reddoch | 100/45 |
| 6,585,115 | B1 * | 7/2003 | Reddoch et al. | 209/3 |
| 6,640,912 | B2 * | 11/2003 | Reddoch | 175/217 |
| 6,658,757 | B2 * | 12/2003 | Fout et al. | 34/76 |
| 6,668,947 | B2 * | 12/2003 | Cordova | 175/66 |
| 6,695,077 | B2 * | 2/2004 | Szymocha et al. | 175/66 |
| 6,698,989 | B2 * | 3/2004 | Snowdon | 414/137.1 |
| 6,702,539 | B2 * | 3/2004 | Snowdon | 414/137.1 |
| 6,709,216 | B2 * | 3/2004 | Snowdon | 414/137.1 |
| 6,709,217 | B1 * | 3/2004 | Snowdon | 414/137.1 |
| 6,715,610 | B2 * | 4/2004 | Wait et al. | 209/10 |
| 6,745,856 | B2 * | 6/2004 | Simpson et al. | 175/66 |
| 6,763,605 | B2 * | 7/2004 | Reddoch | 34/58 |
| 6,910,411 | B2 * | 6/2005 | Reddoch | 100/37 |
| 6,936,092 | B2 * | 8/2005 | Seyffert et al. | 95/271 |
| 6,978,851 | B2 * | 12/2005 | Perez-Cordova | 175/206 |
| 6,988,567 | B2 * | 1/2006 | Burnett et al. | 175/66 |
| 7,033,124 | B2 * | 4/2006 | Snowdon | 414/137.1 |
| 7,186,062 | B2 * | 3/2007 | Snowdon | 406/121 |
| 7,195,084 | B2 * | 3/2007 | Burnett et al. | 175/66 |
| 7,325,629 | B2 * | 2/2008 | Blaschke et al. | 175/66 |
| 7,484,574 | B2 * | 2/2009 | Burnett et al. | 175/66 |
| 7,490,672 | B2 * | 2/2009 | Hollier | 166/357 |
| 7,493,969 | B2 * | 2/2009 | Burnett et al. | 175/88 |
| 7,544,018 | B2 * | 6/2009 | Snowdon | 406/146 |
| 2004/0144405 | A1 * | 7/2004 | Garrick et al. | 134/25.1 |
| 2004/0149395 | A1 * | 8/2004 | Strand | 159/47.1 |
| 2005/0236015 | A1 * | 10/2005 | Goel et al. | 134/10 |
| 2006/0102390 | A1 | 5/2006 | Burnett et al. | |
| 2006/0186056 | A1 * | 8/2006 | Ivan | 210/704 |
| 2007/0051539 | A1 * | 3/2007 | Blaschke et al. | 175/66 |
| 2008/0210466 | A1 | 9/2008 | McDonald et al. | |

OTHER PUBLICATIONS

PCT Written Opinion issued in PCT Application No. PCT/US2007/086881 dated May 13, 2008 (5 pages).

Examination Report issued Nov. 15, 2010 in corresponding application No. GB0909576.1.

International Search Report and Written Opinion issued in PCT Application No. PCT/US2011/050756 dated May 21, 2012 (11 pages).

Official Action issued in Mexican Application No. MX/a/2009/005928 dated Jun. 22, 2012 (2 pages).

International Preliminary Report on Patentability and Written Opinion issued in corresponding International Application No. PCT/US2011/050756 dated Mar. 21, 2013 (7 pages).

* cited by examiner

OFFSHORE THERMAL TREATMENT OF DRILL CUTTINGS FED FROM A BULK TRANSFER SYSTEM

CROSS-REFERENCE TO RELATED APPLICATIONS

This application is a continuation-in-part application which claims priority, pursuant to 35 U.S.C. §120, to U.S. patent application Ser. No. 11/952,047, filed on Dec. 6, 2007 which claims priority to U.S. Patent Application Ser. No. 60/869,175, filed on Dec. 8, 2006, and U.S. Patent Application Ser. No. 60/951,845, filed on Jul. 25, 2007, all of which are incorporated by reference in their entirety.

BACKGROUND OF INVENTION

1. Field of the Invention

Embodiments disclosed herein relate generally to methods and systems for the offshore thermal treatment and disposal of drill cuttings.

2. Background Art

When drilling or completing wells in earth formations, various fluids ("well fluids") are typically used in the well for a variety of reasons. Common uses for well fluids include: lubrication and cooling of drill bit cutting surfaces while drilling generally or drilling-in (i.e., drilling in a targeted petroleum bearing formation), transportation of "cuttings" (pieces of formation dislodged by the cutting action of the teeth on a drill bit) to the surface, controlling formation fluid pressure to prevent blowouts, maintaining well stability, suspending solids in the well, minimizing fluid loss into and stabilizing the formation through which the well is being drilled, fracturing the formation in the vicinity of the well, displacing the fluid within the well with another fluid, cleaning the well, testing the well, implacing a packer fluid, abandoning the well or preparing the well for abandonment, and otherwise treating the well or the formation.

As stated above, one use of well fluids is the removal of rock particles ("cuttings") from the formation being drilled. However, because of the oil content in the recovered cuttings, particularly when the drilling fluid is oil-based or hydrocarbon-based, the cuttings are an environmentally hazardous material, making disposal a problem. That is, the oil from the drilling fluid (as well as any oil from the formation) becomes associated with or adsorbed to the surfaces of the cuttings.

A variety of methods have been proposed to remove adsorbed hydrocarbons from the cuttings. U.S. Pat. No. 5,968,370 discloses one such method which includes applying a treatment fluid to the contaminated cuttings. The treatment fluid includes water, a silicate, a nonionic surfactant, an anionic surfactant, a phosphate builder and a caustic compound. The treatment fluid is then contacted with, and preferably mixed thoroughly with, the contaminated cuttings for a time sufficient to remove the hydrocarbons from at least some of the solid particles. The treatment fluid causes the hydrocarbons to be desorbed and otherwise disassociated from the solid particles.

Furthermore, the hydrocarbons then form a separate homogenous layer from the treatment fluid and any aqueous component. The hydrocarbons are then separated from the treatment fluid and from the solid particles in a separation step, e.g., by skimming. The hydrocarbons are then recovered, and the treatment fluid is recycled by applying the treatment fluid to additional contaminated sludge. The solvent must be processed separately.

Some prior art systems use low-temperature thermal desorption as a means for removing hydrocarbons from extracted soils. Generally speaking, low-temperature thermal desorption (LTTD) is an ex-situ remedial technology that uses heat to physically separate hydrocarbons from excavated soils. Thermal desorbers are designed to heat soils to temperatures sufficient to cause hydrocarbons to volatilize and desorb (physically separate) from the soil. Typically, in prior art systems, some pre- and post-processing of the excavated soil is required when using LTTD. In particular, cuttings are first screened to remove large cuttings (e.g., cuttings that are greater than 2 inches in diameter). These cuttings may be sized (i.e., crushed or shredded) and then introduced back into a feed material. After leaving the desorber, soils are cooled, re-moistened, and stabilized (as necessary) to prepare them for disposal/reuse.

U.S. Pat. No. 5,127,343 (the '343 patent) discloses one prior art apparatus for the low-temperature thermal desorption of hydrocarbons. FIG. 1 from the '343 patent reveals that the apparatus consists of three main parts: a soil treating vessel, a bank of heaters, and a vacuum and gas discharge system. The soil treating vessel is a rectangularly shaped receptacle. The bottom wall of the soil treating vessel has a plurality of vacuum chambers, and each vacuum chamber has an elongated vacuum tube positioned inside. The vacuum tube is surrounded by pea gravel, which traps dirt particles and prevents them from entering a vacuum pump attached to the vacuum tube.

The bank of heaters has a plurality of downwardly directed infrared heaters, which are closely spaced to thoroughly heat the entire surface of soil when the heaters are on. The apparatus functions by heating the soil both radiantly and conventionally, and a vacuum is then pulled through tubes at a point furthest away from the heaters. This vacuum both draws the convection heat (formed by the excitation of the molecules from the infrared radiation) throughout the soil and reduces the vapor pressure within the treatment chamber. Lowering the vapor pressure decreases the boiling point of the hydrocarbons, causing the hydrocarbons to volatize at much lower temperatures than normal. The vacuum then removes the vapors and exhausts them through an exhaust stack, which may include a condenser or a catalytic converter.

Hammermill processes are often also used to recover hydrocarbons from a solid. In the typical hammermill process, the friction principle is used to generate sufficient energy for the oil fractions to be evaporated off. Specifically, a hammer mill with swinging rotor arms are used to finely crush all the particles, which results in the generation of heat, and allows for the evaporation of the oil in the material at a temperature lower than normal evaporation.

U.S. Patent Publication No. 2004/0149395 discloses a rotomill process, based on the hammermill technology, by which adsorbed oil may be evaporated at a temperature lower than its atmospheric boiling point. The presence of a vapor phase of a second component (typically water) allows for a substantial reduction in the partial pressure of the hydrocarbons, and thus a decrease in their boiling point.

Thermal desorption units are typically set up as fixed, land-based installation due to the off shore limitations associated with size, weight, and processing capacity. Thus, to avoid contamination by oil-coated drill cuttings, cuttings are typically transported onshore for processing.

Further complicating the treatment of drill cuttings, when a wellbore fluid brings cuttings to the surface, the mixture is typically subjected to various mechanical treatments (shakers, centrifuges, etc) to separate the cuttings from the recyclable wellbore fluid. However, the separated drill cuttings, which still possess a certain portion of oil from the wellbore fluid absorbed thereto, are in the form of a very thick heavy paste, creating difficulties in handling and transportation. Thus, frequently, in offshore applications, the thick drill cuttings paste is slurrified with a carrier fluid, typically an oil-based fluid, to allow for ease in pumping and handling the drill cuttings paste.

Traditional methods of disposing the drill cuttings include dumping, bucket transport, conveyor belts, screw conveyors, and washing techniques that require large amounts of water. Adding water creates additional problems of added volume and bulk, pollution, and transport problems. Installing conveyors requires major modification to the rig area and involves extensive installation hours and expense. In some instances, the cuttings, which are still contaminated with some oil, are transported from a drilling rig to an offshore rig or ashore in the form of a thick heavy paste or slurry for injection into an earth formation. Typically, the material is put into special skips of about 10 ton capacity that are loaded by crane from the rig onto supply boats. This is a difficult and dangerous operation that may be laborious and expensive.

Another method of disposal includes returning the drill cuttings, drilling mud, and/or other waste via injection under high pressure into an earth formation. Generally, the injection process involves the preparation of a slurry within surface-based equipment and pumping the slurry into a well that extends relatively deep underground into a receiving stratum or adequate formation. The basic steps in the process include the identification of an appropriate stratum or formation for the injection; preparing an appropriate injection well; formulation of the slurry, which includes considering such factors as weight, solids content, pH, gels, etc.; performing the injection operations, which includes determining and monitoring pump rates such as volume per unit time and pressure; and capping the well.

A slurrification system is used to create a slurry for a cuttings re-injection system. Typically, slurrification systems receive cuttings and convert them into a pumpable slurry. Elements of a slurrification system generally include a fine-solids ("fines") tank, a coarse-solids ("coarse") tank, a classification system, and a storage vessel, wherein drill cuttings are dried, separated, and transferred to a cuttings re-injection system or stored for further processing. After preparation of the slurry, the slurry is pumped to a storage vessel, until an injection pump is used to pump the slurry down a wellbore.

In operation, attempts to produce a slurry that meet local environmental regulations and operational regulations has proven problematic. Current slurrification systems are operationally inefficient. For example, adjustments to the drilling operation including adjustments to cuttings volume production and rate of penetration of the wellbore may cause slurrification process and cuttings re-injection inefficiencies. Moreover, increasingly stringent cuttings-discharge regulations have pressured operators and drilling contractors to reduce drilling waste volumes and recover products for re-use. Thus, there exists a continuing need for more efficient slurrification methods and systems, specifically, for slurrification systems for use in preparing slurries for re-injecting cuttings into a wellbore.

Accordingly, there exists a continuing need for improvements in the offshore treatment and disposal of drill cuttings.

SUMMARY OF INVENTION

In one aspect, embodiments disclosed herein relate to a system for offshore treatment of drill cuttings that includes a first pressurized vessel configured to receive contaminated drill cuttings and adapted to allow a compressed gas be introduced therein as the sole means for inducing movement of said contaminated drill cuttings in the first pressurized vessel, whereby at least a portion of the contaminated drill cuttings is discharged from the first pressurized vessel; and a reactor unit in fluid connection with the first pressurized vessel for separating the contaminated drill cuttings into drill cuttings and contaminants, wherein the reactor unit includes a processing chamber having at least one inlet and outlet; and a rotor mounted in the processing chamber, the rotor including a shaft; and a plurality of fixed rotor arms extending radially from the shaft.

In another aspect, embodiments disclosed herein relate to a method offshore treatment of drill cuttings that includes pneumatically conveying contaminated drill cuttings into a first pressurized vessel having a lower conical section structured to achieve mass flow of the contaminated drill cuttings; transferring the contaminated drill cuttings to a reactor unit by applying a compressed gas to the pressurized vessel whereby the contaminated drill cuttings flow out of the pressurized vessel into the reactor vessel by positive pressure; applying heat to the contaminated drill cuttings so as to vaporize contaminants from the contaminated drill cuttings; and removing the vaporized contaminants from the reactor.

In yet another aspect, embodiments disclosed herein relate to a method offshore treatment of drill cuttings that includes pneumatically conveying contaminated drill cuttings into a first pressurized vessel having a lower conical section structured to achieve mass flow of the contaminated drill cuttings; transferring the contaminated drill cuttings to a separator by applying a compressed gas to the pressurized vessel whereby the contaminated drill cuttings flow out of the pressurized vessel into the reactor vessel by positive pressure; removing at least a portion of liquid content from the contaminated drill cuttings; transferring the contaminated drill cuttings to a reactor unit; applying heat to the contaminated drill cuttings so as to vaporize contaminants from the contaminated drill cuttings; and removing the vaporized contaminants from the reactor.

Other aspects and advantages of the invention will be apparent from the following description and the appended claims.

DETAILED DESCRIPTION

In one aspect, embodiments disclosed herein relate to offshore thermal treatment of drill cuttings. In particular, embodiments disclosed herein relate to systems and methods for treating drill cuttings.

Figure 1:
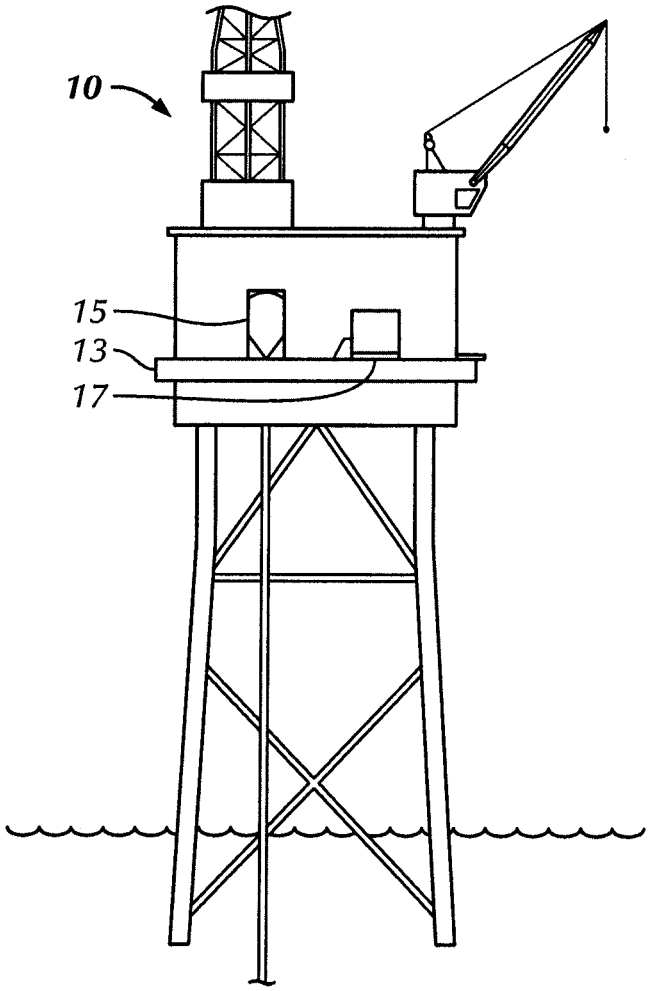
FIG. 1 is a schematic of a system according to one embodiment of the present disclosure.

Referring to FIG. 1, an offshore oil rig 10 on which the treatment of drill cuttings may be performed according to one embodiment of the present disclosure is shown. On the platform 13 of offshore oil rig 10, a pressurized vessel 15 is located. Drill cuttings, after undergoing traditional screening process, are loaded into pressurized vessel 15. From pressurized vessel 15, drill cuttings may exit the pressurized vessel 15 and be loaded into reactor unit 17. In reactor unit 17, at least a portion of the contaminants adsorbed onto the surface of drill cuttings may be removed.

Figure 2:
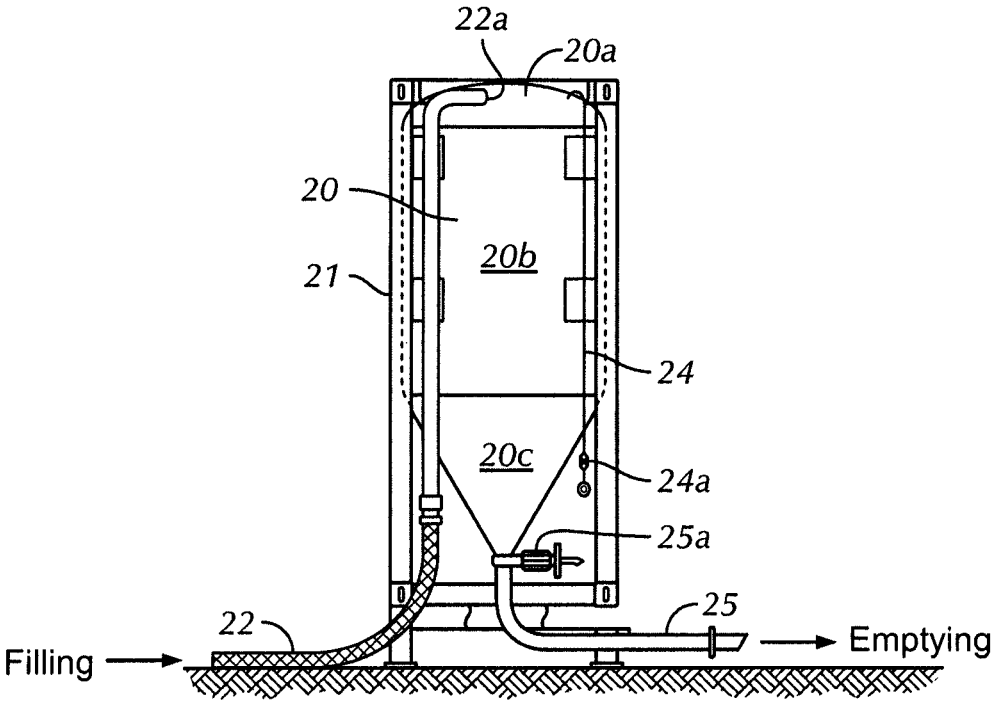
FIG. 2 is a schematic of a pressurized vessel according to one embodiment of the present disclosure.

Referring to FIG. 2, a pressurized vessel according to one embodiment of the present disclosure is shown. As shown in FIG. 2, a pressurized vessel 20 may be located within a support frame 21. Pressurized vessel 20 has a part spherical upper end 20*a*, a cylindrical body section 20*b*, and a lower angled section 20*c*. At the lowermost end of the angled section 20*c*, the vessel is provided with a discharge valve 25*a* having connected thereto a pipe 25. A filling pipe 22 extends into each pressurized vessel 20 via an inlet valve 22*a* at the upper end 20*a* of pressurized vessel 20. Also extending into upper end 20*a* of pressurized vessel 20 is a compressed air line 24 having valves 24*a*.

In a filling operation, prior to loading any drill cuttings into pressurized vessel 20, inlet valve 22*a* is closed. A vent valve (not shown) may be opened to equalize the vessel pressure to ambient air. The inlet valve 22*a* is opened, and the drill cuttings are fed into the pressurized vessel 20. The vent valve may be opened to vent displaced air from the vessel. When the pressurized vessel 20 is full, the inlet valve 22*a* and vent valve are closed, sealing the pressurized vessel. In order to empty a vessel that is filled via pipe 22, inlet valve 22*a* is closed, valve 25*a* is opened, and compressed air is fed into the vessel 20 via air line 24. The drill cuttings are forced out of vessel 20 under the pressure of the compressed air and into pipe 25. While the above embodiment refers to application of compressed air into the pressurized vessel, one of ordinary skill in the art would recognize that it is within the scope of the present disclosure that other inert gases, for example, compressed nitrogen, may be used in place of compressed air. In a particular embodiment, the compressed gas applied to the pressurized vessel may be within a pressure ranging from about 4 to 8 bar.

Due to the angle of the lower angled section being less than a certain value, the material flow out of the vessel is of the type known as mass flow and results in all of the material exiting uniformly out of the vessel. In the case of mass flow, all of the drill cuttings material in the vessel descend or move in a uniform manner towards the outlet, as compared to funnel flow (a central core of material moves, with stagnant materials near the hopper walls). It is known that the critical hopper angle (to achieve mass flow) may vary depending upon the material being conveyed and/or the vessel material. In various embodiments, the angle (from the vertical axis) for mass flow to occur may be less than 40°. One of ordinary skill in the art would recognize that in various embodiments the lower angled section may be conical or otherwise generally pyramidal in shape or otherwise reducing in nature, e.g., a wedge transition or chisel, to promote mass flow. In a particular embodiment, the lower angled section has a minimum discharge dimension of at least about 5 inches (127 mm). The lower angled section may have a discharge dimension that is sized for the desired flow rate of the system 50. In some embodiments, the lower angled section discharge dimension is about 6 inches (152 mm), about 8 inches (203 mm), about 10 inches (254 mm), or about 12 inches (300 mm). After exiting the vessel, the material is typically conveyed in the form of a semi-solid slug along pipe 25.

Figure 3:
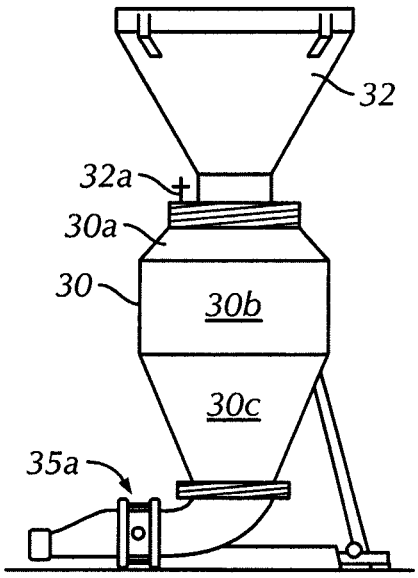
FIG. 3 is a schematic of a pressurized vessel according to another embodiment of the present disclosure.

Referring to FIG. 3, an alternative embodiment of a pressurized vessel is shown. As shown in FIG. 3, pressurized vessel 30 has an upper end 30*a*, a body section 30*b*, and a lower angled section 30*c*. Connected at its upper end 30*a* is feed hopper 32 with an inlet valve 32*a* therebetween. At the lowermost end of the conical section 30*c*, the vessel is provided with a discharge valve 35*a*.

In a filling operation, inlet valve 32*a* is opened, and the drill cuttings are fed into the pressurized vessel 30 through the feed hopper 32, which may optionally be a vibrating feed hopper. When the pressurized vessel 30 is full, the inlet valve 32*a* is closed, sealing the pressurized vessel. In order to empty the valve, inlet valve 32*a* remains closed, discharge valve 35*a* is opened, and compressed air is fed into the vessel 30 via air line (not shown). The drill cuttings are forced out of vessel 30 under the pressure of the compressed air and into a discharge pipe (not shown). Due to the selected angle of the lower angled section being less than a certain value, the material flow out of the vessel is of the type known as mass flow and results in all of the material exiting uniformly out of the vessel.

One of ordinary skill in the art would recognize that in alternate embodiments, any number of pressurized vessels may be used, which may be connected in series or with a common material filling pipe and a common material discharge pipe. In a particular embodiment, drill cuttings may be conveyed from shakers (or other separation means) into a pressurized vessel having a feed chute attached thereto, such as that described in FIG. 3, and then be discharged from the first pressurized vessel and conveyed into a second pressurized vessel, such as that described in FIG. 2.

Pressurized vessel 20 may be filled with drill cuttings by various means. In one embodiment, filling pipe 22 and thus inlet valve 22*a*, which empty drill cuttings into pressurized vessel 20, may be supplied with drill cuttings for processing by vacuum assistance. For example, a vacuum collection system, as described in U.S. Pat. Nos. 5,402,857, 5,564,509, and 6,213,227, which are assigned to the present assignee and incorporated herein by reference in there entirety, may be used to deliver drill cuttings from a cuttings trough to the pressurized vessel of the present disclosure. In another embodiment, cuttings may be fed directly from a shaker and/or cuttings trough to a pressurized vessel, such as through a feed hopper, as shown in FIG. 3.

Figure 4:
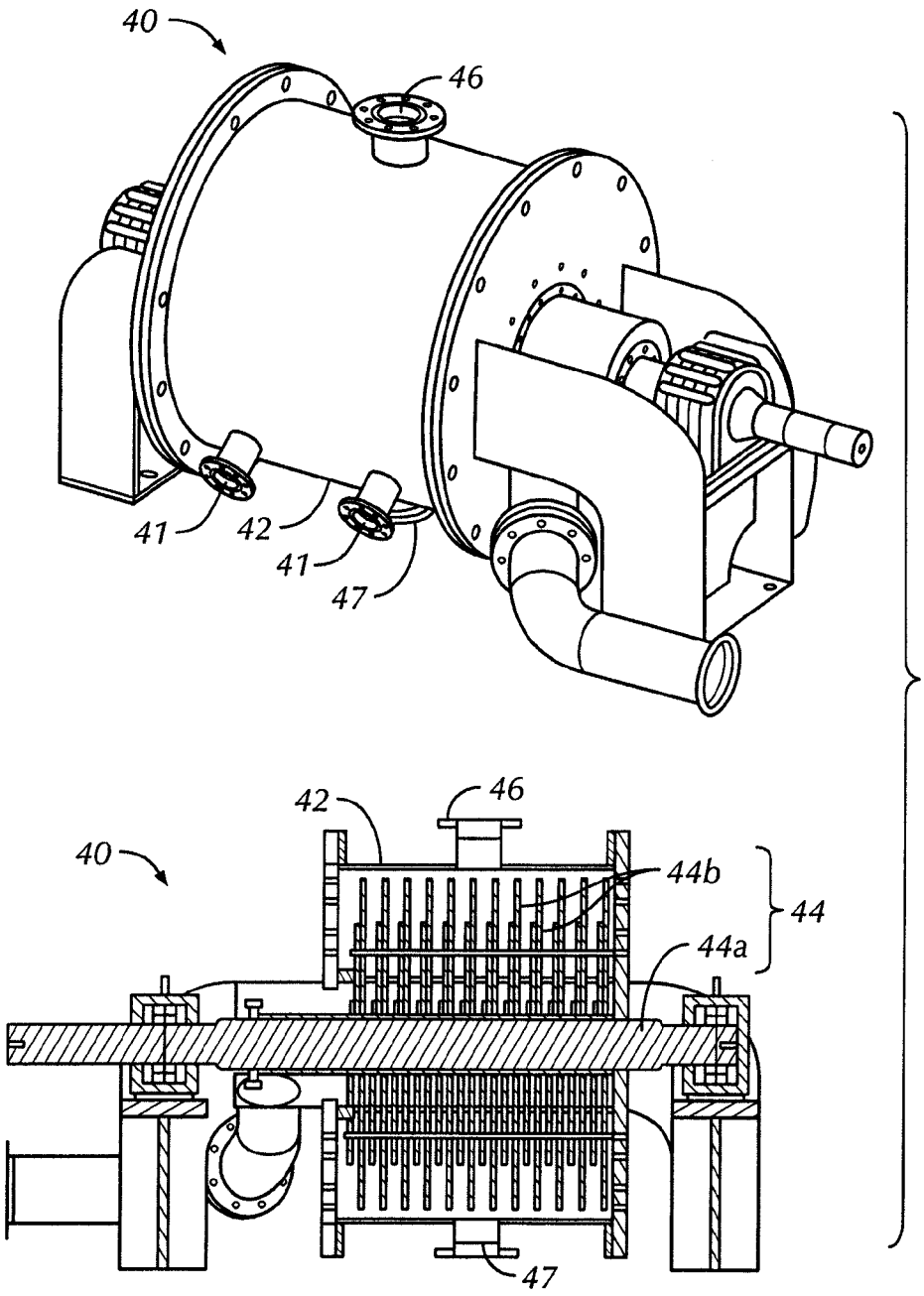
FIG. 4 is a schematic of a reactor unit according to one embodiment of the present disclosure.

As the addition of compressed air into the pressurized vessel(s) discharges the drill cuttings therefrom, the cuttings may be conveyed through discharge pipes into a reactor unit wherein at least a portion of the contaminants adsorbed to the surface of the cuttings may be removed. Referring to FIG. 4, a reactor unit according to one embodiment of the present disclosure is shown. As shown in FIG. 4, reactor unit 40 includes a cylindrical processing chamber 42 into which drill cuttings are loaded through inlet(s) 41. While not shown in FIG. 4, one of ordinary skill in the art would recognize that inlet(s) 41 may receive drill cuttings directly from a pressurized vessel, such as those shown in FIGS. 2 and 3, or indirectly through a feed hopper, as known in the art.

Mounted in processing chamber 42 is a rotor 44. Rotor 44 includes a shaft 44*a* and a plurality of fixed rotor arms 44*b*. Rotor arms 44*b* extend radially from shaft 44*a* in axially aligned rows. Rotor 44 rotates within processing chamber 42 via a motor (not shown). As rotor 44 rotates within processing chamber 42, an annular bed of drill cuttings is formed against the inner surface of the processing chamber 42. The rotation of the arms may vary, for example, such that the tangential velocity of the ends of the rotor arms ranges from about 10 to 100 m/s, and from about 30 to 40 m/s in other embodiments.

Frictional forces, and thus heat, are generated as the drill cuttings interact with the inner surfaces of the processing chamber 42. As the generated heat amounts, the contaminants adsorbed to the surface of the cuttings may be vaporized, exiting the reactor unit through vapor outlets 46. Dried drill cuttings may exit the reactor vessel through outlets 47.

In one embodiment, the cylindrical processing chamber having a diameter ranging from 0.5-5 m, and about 1 m in another embodiment. The number of rotor arms may depend on the particular size of the processing chamber, but may range, in various embodiments, from 10-100 arms per square meter of the inner wall of the processing chamber. Further, the arms may extend radially toward the inner wall of the processing chamber to a clearance of less than 0.1 m. However, one of ordinary skill in the art would recognize that the number of rotor arms, etc, may vary and depend upon the selected size of the processing chamber.

Other reactor units that may be used in combination with the pneumatic transfer system disclosed herein may include those used onshore for the treatment of contaminated drill cuttings such as, for example, the reactor unit described in U.S. Patent Publication No. 2004/0149395, which is herein incorporated by reference in its entirety. One particular example of a reactor vessel suitable for use in the present disclosure is commercially available from Thermtech (Bergen, Norway) under the trade name Thermomechanical Cuttings Cleaner (TCC). Other reactor units that may be used in conjunction with the pressurized vessels as described herein may include those described in U.S. Pat. No. 6,658,757 and WO 06/003400, which are herein incorporated by reference in their entirety.

As described in U.S. Patent Publication No. 2004/0149395, by selecting dimensions and operating parameters for the reactor unit, a sufficient amount of energy may be generated to initiate vaporization of the contaminants adsorbed to the surface of the drill cuttings. Furthermore, because of the presence of more than one contaminant having differing boiling points, the vaporization of the contaminant having a higher boiling point may occur at a temperature less than the atmospheric boiling point. That is, the presence of one component, e.g., an aqueous fluid, may provide for a partial pressure of the gas phase of a second component, e.g., oil, less than atmospheric pressure, thus reducing the boiling point of the second component. In a particular embodiment, the contaminants include both an oil phase and an aqueous phase. In other embodiments, a aqueous phase may be added to the reactor, such as in the form of vapors, to reduce the partial pressure of the oil contaminants and reduce the amount of energy necessary to vaporize the oil contaminants.

Typically, drilling fluids, and thus drilling contaminants, have a water/oil ratio of at least about 1:2 by mass. Oil-based fluids used in wellbore fluids have an average molecular weight of 218 g/mol (corresponding to an average carbon chain length of $C_{16}$), whereas water has a molecular weight of 18 g/mol. With a mass ratio of at least 1:2, the volume fraction of oil vapors when all water and oil has evaporated will be 14% [(2/216)/(1/18+2/216)]. Such a partial pressure may allow for the boiling point reduction of approximately 50° C. for the oil portion.

Figure 5:
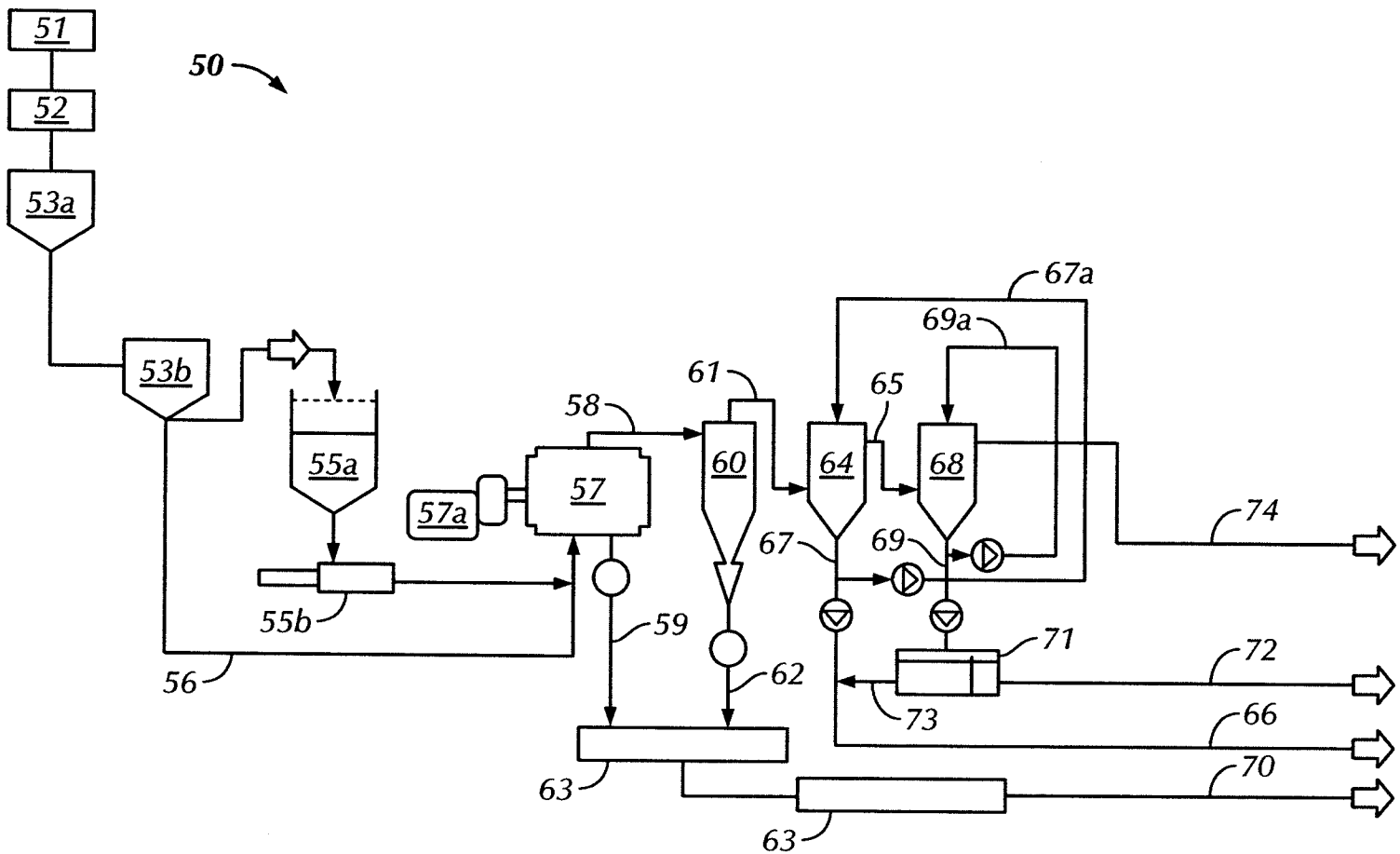
FIG. 5 is a schematic of a system according to another embodiment of the present disclosure.

Referring to FIG. 5, another embodiment of a treatment system of the present disclosure is shown. As shown in FIG. 5, drill cuttings 51 arising from the drilling process are subjected to a screening device 52, e.g., shakers. From the shakers, the screened cuttings are loaded into a feed hopper (not shown) attached to first pressurized vessel 53. From first pressurized vessel 53*a*, drill cuttings are conveyed into a second pressurized vessel 53*b* via the addition of a compressed gas (not shown). As illustrated, system 50 includes a first pressurized vessel 53*a* and a second pressurized vessel 53*b*; however, one of skill in the art would recognize that in various other embodiments, the system may include any number of pressurized vessels, such as a single pressurized vessel or more than two pressurized vessels. Addition of a compressed gas (not shown) into pressurized vessel 53*b* allows for the conveyance of drill cuttings out of pressurized vessel 53*b* and into reactor unit 57, either directly through feed line 56 or indirectly through feed hopper 55*a* and hydraulic feed pump 55*b*. However, one of ordinary skill in the art would appreciate that the transfer could occur via other means, such as, for example, through hopper 55*a* and rotary valve (not shown). In a particular embodiment, the drill cuttings may be conveyed from pressurized vessel 53*b* to reactor unit 57 at a rate of up to 40 MT/hr. However, one of skill in the art would recognize that the transfer rate may be dependent upon a number of factors, such as the material being transferred.

In reactor unit 57, a plurality of rotor arms (not shown) are caused to rotate by the drive unit 57*a*, generating heat. The generation of heat vaporizes at least a portion of the contaminants 58 adsorbed to the surface of the drill cuttings 59. Contaminants 58 are evacuated from the reactor vessel 57 and passed through a cyclone 60. In cyclone 60, any particulate matter 62 that is present in contaminants 58 is separated from vapors 61. Vapors 61 are then passed through an oil condenser 64 to allow for the condensation of oil vapors and separation from vapors 65, which are then fed to water condenser 68. In some embodiments, condensed oil portion 67 may be recirculated 67*a* into oil condenser 64. Optionally, condensed oil portion 67 may undergo heat exchange (not shown) prior to re-circulation into the oil condenser 64. In other embodiments, condensed oil portion 67 may be directed for collection at oil recovery 66.

Vapors 65 may be directed from oil condenser 64 to water condenser 68 to allow for the condensation of water vapors and separation from non-condensable gases 74. In some embodiments, condensed water portion 69 may be re-circulated 69*a* into water condenser 68. Optionally, condensed water portion 69 may undergo heat exchange (not shown) prior to re-circulation into the water condenser 68. In other embodiments, condensed water portion 69 may be directed into collection tank 71. In collection tank 71, a weir arrangement may be disposed to allow for separation of any residual oil phase 73 from recovered water 72.

Dried drill cuttings 59 exit reactor unit 57 and are conveyed through a screw conveyor 63, or the like, to solids recovery 70. Any particulate matter 62 separated from vapors 61 in cyclone 60 are also fed to solids recovery 70 via screw conveyor 63. Recovered solids 70 may, in various embodiments, be subjected to disposal (e.g., cuttings re-injection) or stored for later disposal or use. Recovered water 72 and oil 66 components may find further use, such as re-circulation into drilling fluids.

Figure 6:
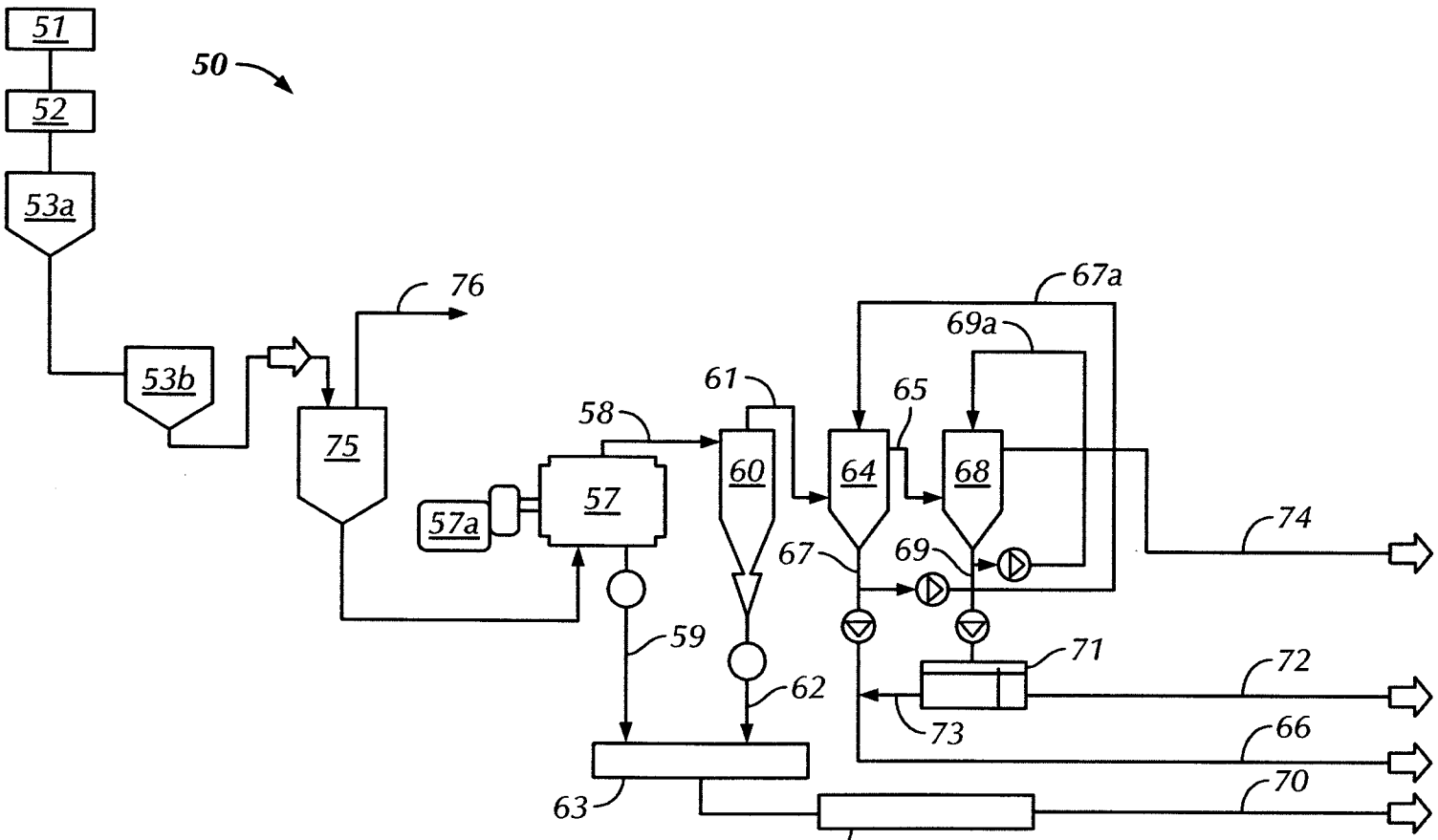
FIG. 6 is a schematic of a system according to another embodiment of the present disclosure.

Referring to FIG. 6, another embodiment of a treatment system of the present disclosure is shown. Similar to the embodiment shown in FIG. 5, drill cuttings 51 arising from the drilling process are subjected to a screening device 52, e.g., shakers. From the shakers, the screened cuttings are loaded into a feed hopper (not shown) attached to first pressurized vessel 53. From first pressurized vessel 53*a*, drill cuttings are conveyed into a second pressurized vessel 53*b* via the addition of a compressed gas (not shown). As illustrated, system 50 includes a first pressurized vessel 53*a* and a second pressurized vessel 53*b*, however, one of skill in the art would recognize that in various other embodiments, the system may include any number of pressurized vessels, such as a single pressurized vessel or more than two pressurized vessels. Addition of a compressed gas (not shown) into pressurized vessel 53*b* allows for the conveyance of drill cuttings out of pressurized vessel 53*b* and into separator 75. In separator 75, at a least a portion of the liquid content 76 of the contaminated drill cuttings may be removed therefrom to increase the feed and throughput of the reactor unit 57. One of ordinary skill in the art would appreciate that liquid content 76 may be subjected to subsequent separation means to separate liquid content 76 into oil and aqueous portions if necessary. Separator 75 may include one or more of centrifuges, hydrocyclones, dryers, hydrocyclone shakers, or combinations thereof, for example. In a particular embodiment, separator 75 may include a vertical centrifuge rotary cuttings dryer, such as the VERTI-G™ cuttings dryer available from M-I LLC (Houston, Tex.). As described above, conveyances may occur directly through feed lines or indirectly through feed hoppers, hydraulic feed pumps and/or rotary valves, and the like.

Following removal of at least a portion of the liquid content from contaminated drill cuttings, contaminated drill cuttings are conveyed to reactor unit 57, for example, by the various means described above. In reactor unit 57, a plurality of rotor arms (not shown) are caused to rotate by the drive unit 57*a*, generating heat. The generation of heat vaporizes at least a portion of the contaminants 58 adsorbed to the surface of the drill cuttings 59. Contaminants 58 are evacuated from the reactor vessel 57 and passed through a cyclone 60. In cyclone 60, any particulate matter 62 that is present in contaminants 58 is separated from vapors 61. Vapors 61 are then passed through an oil condenser 64 to allow for the condensation of oil vapors and separation from vapors 65, which are then fed to water condenser 68. In some embodiments, condensed oil portion 67 may be re-circulated 67*a* into oil condenser 64. Optionally, condensed oil portion 67 may undergo heat exchange (not shown) prior to re-circulation into the oil condenser 64. In other embodiments, condensed oil portion 67 may be directed for collection at oil recovery 66.

Vapors 65 may be directed from oil condenser 64 to water condenser 68 to allow for the condensation of water vapors and separation from non-condensable gases 74. In some embodiments, condensed water portion 69 may be re-circulated 69*a* into water condenser 68. Optionally, condensed water portion 69 may undergo heat exchange (not shown) prior to re-circulation into the water condenser 68. In other embodiments, condensed water portion 69 may be directed into collection tank 71. In collection tank 71, a weir arrangement may be disposed to allow for separation of any residual oil phase 73 from recovered water 72.

Dried drill cuttings 59 exit reactor unit 57 and are conveyed through a screw conveyor 63, or the like, to solids recovery 70. Any particulate matter 62 separated from vapors 61 in cyclone 60 are also fed to solids recovery 70 via screw conveyor 63. Recovered solids 70 may, in various embodiments, be subjected to disposal (e.g., cuttings re-injection) or stored for later disposal or use. Recovered water 72 and oil 66 components may find further use, such as re-circulation into drilling fluids.

Figure 7:
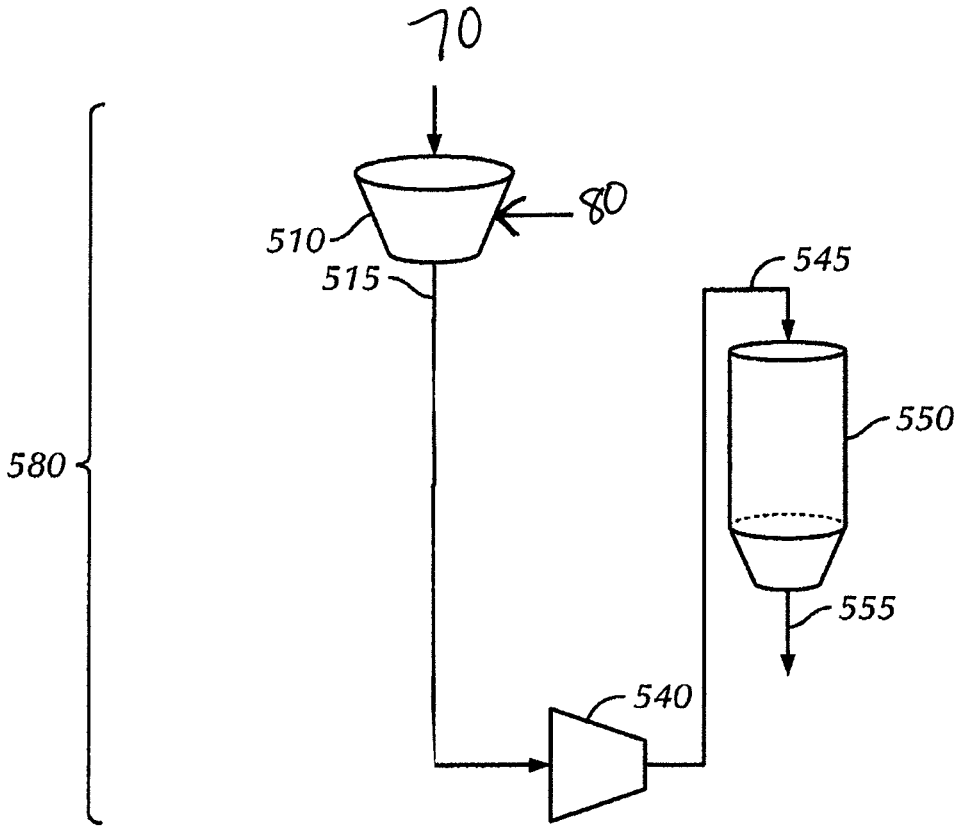
FIG. 7 shows a system for the slurrification of drill cuttings according to one embodiment of the present disclosure.

Referring to FIG. 7, recovered solids 70 are transferred to a buffer tank 510 in a slurrification system 580. In some embodiments, the recovered solids 70 range in size from about 5 to about 15 microns, preferably about 9 microns. One skilled in the art would be able to design a slurrification system 580 for any size range of the recovered solids 70. The dried cuttings 59 preferably have less than 1% of contaminants. The recovered solids 70 are mixed with a fluid 80 in the buffer tank 510, to create a slurry. In such an embodiment, the fluid injected may include, for example, water, sea water, brine solution, or liquid polymers, as would typically be used in preparation of a slurry for re-injection. The water and additives may come from storage tanks, fluid lines, and other available sources of water and additives known to those of ordinary skill in the art. In some embodiments, the fluid is a viscosifier, such as, but not limited to, xantham gum. An example of a xantham gum viscosifier is DuoV available from M-I Swaco, in Houston, Tex. In some embodiments, the viscosifier may be an environmentally friendly viscosifier. One skilled in the art would be able to design the amount of fluid necessary for the slurrification system 580 based upon operating conditions. While not bound by theory, small particle sizes of the recovered solids may result in lower volumes of fluid being injected, i.e. fewer batches which in turn may reduce the number of times reinjection may be performed, may reduce the number of times flushing occurs, and may reduce the number of high viscosity fluid spacers.

In alternate embodiments, the fluid 80 may be mixed with the recovered solids 70 in the pump 540. In such an embodiment, the pump 540 facilitates the mixing of the fluid with the recovered solids 70, thereby creating a fluid-solid mixture. In one aspect, the pump 540 may create a vacuum which draws the fluid and cuttings into pump. The fluid-solid mixture may be subjected to mechanical and hydraulic shear to create a slurry. One example of a pump that may be used with embodiments disclosed herein is the FLASHBLEND™ HIGH SHEAR POWDER/LIQUID MIXER, commercially available from Silverson Machines, Inc. However, other mixing and pumping devices, operable as disclosed above, may alternatively be used with embodiments of the present methods and systems. Those of ordinary skill in the art will appreciate that examples of other pumps that may be used to facilitate the mixing of a solid and fluid include centrifugal pumps. The pump 540 may also include design features such as hardfacing over rotors or stators, as well as other features known to those of skill in the art to further extend the life and/or effectiveness of the components.

The slurry enter a transfer line 515 fluidly connected to pump 540. The slurry exits pump 540 and passes into a storage vessel 550 via a slurry transfer line 545. Storage vessel 550 may either hold the slurry for a future use or facilitate the transfer of the slurry to a cuttings re-injection system (not independently shown) through a CRI transfer line 555. As compared to typical re-injection processes, the amount of fluid to slurry the recovered solids 70 might be expected to be reduced. In some embodiments, the amount of fluid to slurry the recovered solids 70 might be expected to be reduced by at least about 20 vol %, at least about 30 vol %, at least about 40 vol %, at least about 50 vol %, or more.

One of ordinary skill in the art would recognize that in alternate embodiments, the recovered solids 70 may be transported to any number of pressurized vessels for storage before entering the slurrification process. The pressurized vessels may be connected in series or with a common material filling pipe and a common material discharge pipe. In a particular embodiment, recovered solids 70 may be conveyed from the screw conveyor 63 into a cuttings storage vessel, such as those described in FIG. 3, and then be discharged from the first pressurized vessel and conveyed into a second pressurized vessel, such as that described in FIG. 2. Cuttings storage vessel may include raw material storage tanks, waste storage tanks, or any other vessels commonly used in association with drilling processes. Specifically, cuttings storage vessel may include cuttings boxes, ISO-tanks, and pneumatic transfer vessels. An example of a pneumatic transfer vessel is the ISO-PUMP™, discussed above. In some embodiments, cuttings storage vessel may include several individual vessels connected to allow the transference of cuttings therebetween. Cuttings storage vessel may be located within a support framework, such as an ISO container frame. As such, those of ordinary skill in the art will appreciate that storage vessel may be used for both drill cuttings storage and transport. An example of a commercially available pneumatic transfer device that may be used in aspects of the present disclosure includes the CLEANCUT™ CUTTINGS BLOWER ("CCB"), from M-I LLC, in Houston, Tex. In other embodiments, the pneumatic transfer system may include, for example ISO-vessels, or other cuttings storage vessels, as described above.

The recovered solids 70 may be provided from the reactor 57 or a mechanical degrading device, such as a grinder that produces a ground waste product. Grinder may include a rollermill, ball mill, or hammermill, and may further include multiple grinders in series or parallel configuration.

In an alternate embodiment, the reactor 57 is bypassed and drill cuttings may be fed into slurrification system 580 from pressurized vessel 53*b* into buffer tank 510, either directly through feed line 56 or indirectly through feed hopper 55*a* and hydraulic feed pump 55*b*. As illustrated, system 50 includes a first pressurized vessel 53*a* and a second pressurized vessel 53*b*; however, one of skill in the art would recognize that in various other embodiments, the system may include any number of pressurized vessels, such as a single pressurized vessel or more than two pressurized vessels. Addition of a compressed gas (not shown) into pressurized vessel 53*b* allows for the conveyance of drill cuttings out of pressurized vessel 53*b* and into buffer tank 510. However, one of ordinary skill in the art would appreciate that the transfer could occur via other means, such as, for example, through hopper 55*a* and rotary valve (not shown). Oversize solids to the slurrification process 580 may be separated by a shaker and routed to the reactor 57 for particle size reduction. In yet another embodiment, drill cuttings may be fed into slurrification system 580 from separator 75 into buffer tank 510.

Figure 8:
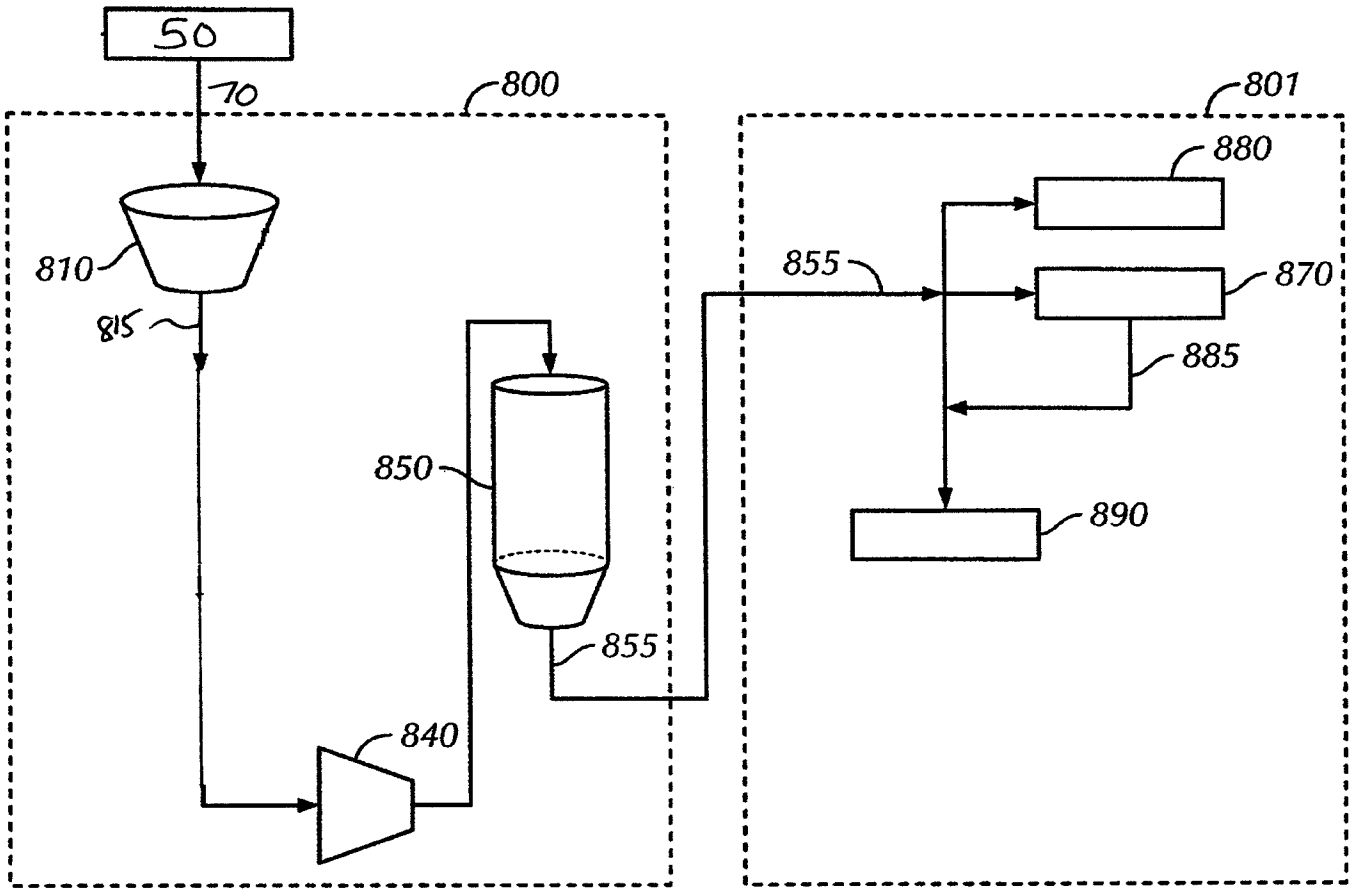
FIG. 8 shows a system for the re-injection of drill cuttings according to one embodiment of the present disclosure.

Referring to FIG. 8, a slurrification system 800 and a cuttings re-injection system 801 in accordance with one embodiment of the present disclosure is shown. In this embodiment, slurrification system 800, may be coupled with the reactor 57, as described in FIGS. 5 and 6. As described above, cuttings are processed by treatment system 50, as shown in FIGS. 5 and 6, wherein the recovered solids 70 enter slurrification process 800. In slurrification process 800, the cuttings are processed by a buffer tank 810. The cuttings are mixed with a fluid in the buffer tank 810 and fed to a pump 840 through transfer line 815, wherein the resulting slurry is transferred to a storage vessel 850. In this embodiment, the slurry exits the slurrification system and is introduced into cuttings re-injection system 801 via a CRI transfer line 855. In this embodiment, the slurry may be transferred to a classifier 870. In one aspect, classifier 870 determines the size range of the slurry based on diameter (i.e., particle size) and discharges the slurry to cuttings re-injection system 801 via a transfer line 885.

In another embodiment, classifier 870 may transfer the slurry to a high-pressure injection pump 890 disposed proximate wellbore via transfer line 885. As the slurry is produced by slurrification system 800, injection pump 890 may be actuated to pump the slurry into a wellbore (not independently shown). Those of ordinary skill in the art will appreciate that the re-injection process may be substantially continuous due to the operating conditions of the slurrification system. In-line slurrification systems may be continuously supplied cuttings from a drilling operation, thereby producing a substantially continuous supply of slurry for a cuttings re-injection system. Thus, once a cuttings re-injection cycle is initiated, it may remain in substantially continuous operation until a drilling operator terminates the operation. As such, even if a re-injection process is stopped, the separation of solids from the suspension may be avoided.

In aspects of this embodiment, the slurry may enter high-pressure pumps (not independently shown), low-pressure pumps (not independently shown), or both types of pumps, to facilitate the transfer of the slurry into a wellbore. In one embodiment, the pumps may be in fluid communication with each other, so as to control the pressure at which the slurry is injected downhole. However, to further control the injection of the slurry, additional components, such as pressure relief valves (not independently shown) may be added in-line prior to the dispersal of the slurry in the wellbore. Such pressure relief valves may help control the pressure of the injection process to increase the safety of the operation and/or to control the speed of the injection to further increase the efficiency of the re-injection. The slurry is then transferred to downhole tubing for injection into the wellbore. Downhole tubing may include flexible lines, existing piping, or other tubing know in the art for the re-injection of cuttings into a wellbore.

In one embodiment, the slurry may be transferred to a temporary storage vessel 880, wherein the slurry may be stored for future use in periods of overproduction. Temporary storage vessel may include vessels discussed above, such as, for example, ISO-vessels or other storage vessels that operate in accordance with the present disclosure.

Figure 9:
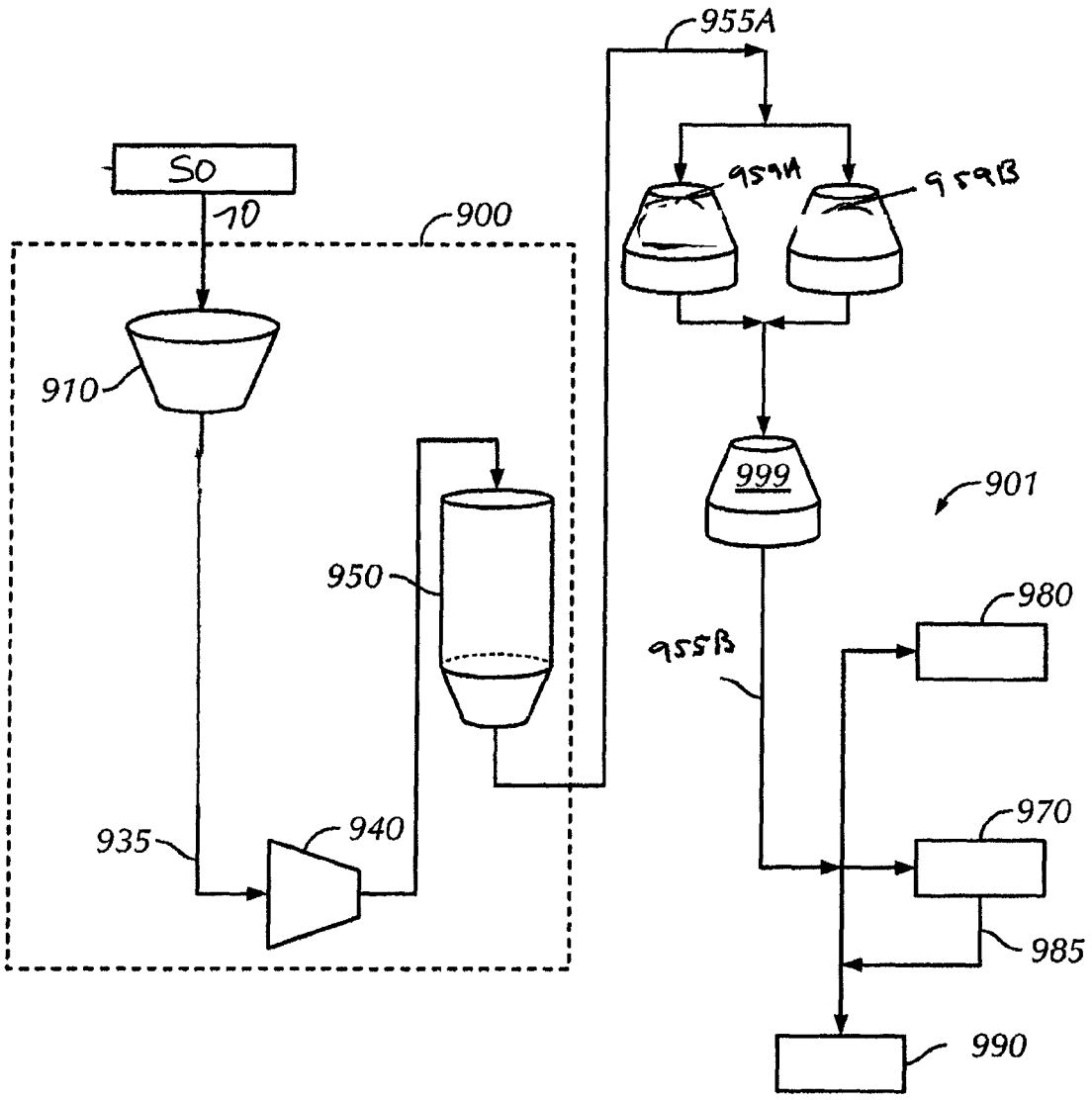
FIG. 9 shows a system for the re-injection of drill cuttings according to one embodiment of the present disclosure.

Referring to FIG. 9, a slurrification system 900 in accordance with one embodiment of the present disclosure is shown. In this embodiment, slurrification system 900, may be coupled with the treatment system 50, as described in FIGS. 5 and 6 and a cuttings re-injection system 901. As described above, cuttings are processed by treatment system 50, wherein the recovered solids 70 enter slurrification process 900. In slurrification process 900, the cuttings are processed by a buffer tank 910 and a transfer line 935. The cuttings are mixed with a fluid in the buffer tank 910 and transferred to a pump 940 via transfer line 935, wherein the resulting slurry is transferred to a storage vessel 950. In the embodiment shown in FIG. 9, the slurry exits slurrification system 900 and is introduced into cuttings re-injection system 901 via a CRI transfer line 955A. In one embodiment, slurrification system 900 may be combined with other slurrification systems known in the art. For example, the slurry may pass through slurrification system 900 and move on to a series of additional slurrification devices, such as a coarse tank 959A, a fines tank 959B, and a batch holding tank 999. After slurrification, the slurry may be transferred to a high pressure pump 990, temporary storage 980, and/or classifier 970 via transfer line 955B, as discussed above. Once the slurry enters classifier 970, it may be directed to high pressure pump 990 via a transfer line 985.

In one embodiment, a sensor (e.g., a density sensor, a viscometer, and/or a conductivity sensor) may be operatively coupled to a valve to open or close the valve when a pre-determined condition of the slurry is met. For example, in one embodiment, a density sensor may be coupled to a valve, such that, when the density of the slurry exiting a pump reaches a pre-determined value, the valve moves (i.e., opens or closes), and redirects the flow of the slurry from a storage vessel to a second storage vessel, a slurry tank, a skip, or a injection pump for injection into a formation.

In another embodiment, a conductivity sensor may be coupled to a valve, such that, when the density of the slurry exiting a pump reaches a pre-determined value, the valve moves and redirects the flow of the slurry from storage a vessel to a second storage vessel, a slurry tank, a skip, or injection pump for injection into a formation. Those of ordinary skill in the art will appreciate that other apparatus and methods may be used to redirect the flow of the slurry once a specified condition (i.e., density, conductivity, or viscosity) is met.

In yet another embodiment, the flow of cuttings, fluids, and other contents of the slurrification system may be controlled by an operatively connected programmable logic controller ("PLC"). The PLC may contain instructions for controlling the operation of a pump; such that a slurry of a specified solids content may be produced. Additionally, in certain aspects, the PLC may contain independent instructions for controlling the operation of the pump inlet or outlet. Examples of instructions may include time dependent instructions that control the time the slurry remains in a pump prior to transference through an outlet. In other aspects, the PLC may control the rate of dry material injected into a pump, or the rate of fluid transmittance through, or into, a transfer line. In still other embodiments, the PLC may control the addition of chemical and/or polymer additives as they are optionally injected into a transfer line. Those of ordinary skill in the art will appreciate that the PLC may be used to automate the addition of dry materials, fluids, and/or chemicals, and may further be used to monitor and/or control operation of the slurrification system or pump. Moreover, the PLC may be used alone or in conjunction with a supervisory control and data acquisition system to further control the operations of the slurrification system. In one embodiment, the PLC may be operatively connected to a rig management system, and may thus be controlled by a drilling operator either at another location of the work site, or at a location remote from the work site, such as a drilling operations headquarters.

The PLC may also include instructions for controlling the mixing of the fluid and the cuttings according to a specified mixing profile. Examples of mixing profiles may include step-based mixing and/or ramped mixing. Step-based mixing may include controlling the mixing of cuttings with the fluid such that a predetermined quantity of cuttings are injected to a known volume of fluid, mixed, then transferred out of the system. Ramped mixing may include providing a stream of cuttings to a fluid until a determined concentration of cuttings in reached. Subsequently, the fluid containing the specified concentration of cuttings may be transferred out of the system.

In another embodiment, a density sensor may be integral with a mixing pump, in-line before or after a storage vessel, and/or coupled to a valve anywhere in the slurrification process prior to the cuttings re-injection system, as discussed above. A valve coupled to the density sensor will allow for recirculation of the slurry through the slurrification system until the density of the slurry reaches a value determined by requirements of a given operation. In one embodiment, a valve, coupled with a density sensor and integral to a mixing pump, moves (i.e., opens or closes) and redirects the flow of the cuttings back to a buffer tank for further processing through a slurrification system. This embodiment provides a method for producing a slurry with an environmentally acceptable density.

In another embodiment, a conductivity sensor may be coupled to a valve, integral with a mixing pump, in-line before or after a storage vessel, and/or coupled to a valve anywhere in the slurrification process prior to the cuttings re-injection system, as discussed above. A valve coupled to the conductivity sensor will allow for recirculation of the slurry through the slurrification system until the conductivity of the slurry reaches a value determined by requirements of a given operation. In one embodiment, a valve, coupled with a density sensor and integral to a mixing pump, moves (i.e., opens or closes) and redirects the flow of the cuttings back to a buffer tank for further processing through a slurrification system. Those of ordinary skill in the art will appreciate that other apparatus and methods may be used to redirect the flow of the slurry once a predetermined concentration of cuttings in suspension, density, or conductivity has been met.

In one embodiment, the slurrification system may be substantially self-contained on a skid. A skid may be as simple as a metal fixture on which components of the slurrification system are securably attached, or in other embodiments, may include a housing, substantially enclosing the slurrification system. When the slurrification system is disposed on a skid, a drilling operation that requires a system that may benefit from increased solids content in a re-injection slurry, the slurrification system may be easily transported to the work site (e.g., a land-based rig, an off-shore rig, or a re-injection site). Those of ordinary skill in the art will appreciate that while the slurrification system may be disposed on a rig, in certain embodiments, the slurrification system may include disparate components individually provided to a work site. Thus, non-modular systems, for example those systems not including a skid, are still within the scope of the present disclosure.

Cuttings transfer systems, slurrification systems, and cuttings re-injection systems, as described above, are typically independent systems, where the systems may be located on rig permanently or may be transferred to rig from a supply boat when such operations are required. However, in embodiments disclosed herein, a system module may be located on a rig proximate cuttings storage vessels, and transfer lines may be connected therebetween to enable use of the cuttings storage vessels with tanks, pumps, grinding pumps, chemical addition devices, cleaning equipment, water supply tanks, cuttings dryers, and other components that may be used in other operations performed at a drilling location. Furthermore, embodiments of the present disclosure may be integrated to slurrification systems wherein the slurry is created in transit between collection points (i.e., at a rig or platform) and at an injection point (i.e., at a second rig, platform, or land-based drilling operations/injection site). Examples of such systems are disclosed in U.S. Provisional Application No. 60/887,449, assigned to the assignee of the present application, and hereby incorporated by reference in its entirety.

Advantageously, embodiments of the present disclosure provide for at least one of the following. Offshore treatment and disposal of drill cuttings may be achieved with pneumatic conveyance of the contaminated drill cuttings from the drilling process to a thermal desorption unit. Further, the pneumatic nature of the conveyance of the drill cuttings and the ability of the pressurized vessels to act as storage containers may allow for contaminated drill cuttings to be filled in the pressurized vessel over a period of time. However, whenever treatment of the cuttings is desired, compressed gas may be fed into the pressurized vessel, allowing for pneumatic conveyance of the drill cuttings to a thermal desorption unit in a relatively short period of time, without requiring the addition of any base oils or other carrier fluids to enable conveyance. The treated cuttings may be slurried with fluid and re-injected into a wellbore. Thus, efficiency in transportation and treatment of the drill cuttings may be obtained.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

What is claimed:

1. A method for offshore treatment of drill cuttings, comprising:

pneumatically conveying contaminated drill cuttings into a first pressurized vessel having a lower conical section structured to achieve mass flow of the contaminated drill cuttings;

transferring the contaminated drill cuttings to a reactor unit by applying a compressed gas to the pressurized vessel whereby the contaminated drill cuttings flow out of the pressurized vessel into the reactor unit by positive pressure;

applying heat to the contaminated drill cuttings so as to vaporize contaminants from the contaminated drill cuttings;

removing the vaporized contaminants from the reactor; and re-injecting the de-contaminated drill cuttings into a well.

2. A method for offshore treatment and disposal of drill cuttings, comprising:

pneumatically conveying contaminated drill cuttings into a pressurized vessel structured to achieve mass flow of the contaminated drill cuttings;

transferring the contaminated drill cuttings to a reactor unit by applying a compressed gas to the pressurized vessel whereby the contaminated drill cuttings flow out of the pressurized vessel into the reactor unit by positive pressure;

applying heat to the contaminated drill cuttings so as to vaporize contaminants from the contaminated drill cuttings while also producing drill cuttings having a reduced size;

removing the vaporized contaminants and the reduced size drill cuttings from the reactor;

combining a fluid with the reduced size drill cuttings to produce a slurry; and re-injecting the slurry into a well.

3. The method of claim 2, wherein the method further comprises:

classifying the slurry with a classifier.

4. The method of claim 3, wherein the classifier comprises:

determining at least one of a group consisting of a density of the slurry and a viscosity of the slurry.

5. The method of claim 2, wherein the fluid comprises water, sea water, brine solution, liquid polymers, or combinations thereof.

6. The method of claim 2, wherein the size of the reduced size drill cuttings is about 9 microns.

7. The method of claim 2, further comprising storing the slurry.

8. The method of claim 2, wherein the combining occurs in a tank.

9. The method of claim 2, wherein the combining occurs in a pump.

10. A method of offshore treatment of drill cuttings, comprising:

pneumatically conveying contaminated drill cuttings into a first pressurized vessel having a lower conical section structured to achieve mass flow of the contaminated drill cuttings;

transferring the contaminated drill cuttings to a separator by applying a compressed gas to the pressurized vessel whereby the contaminated drill cuttings flow out of the pressurized vessel into the separator by positive pressure;

removing at least a portion of liquid content from the contaminated drill cuttings;

transferring the contaminated drill cuttings to a reactor unit;

applying heat to the contaminated drill cuttings so as to vaporize contaminants from the contaminated drill cuttings and produce dry cuttings;

removing the vaporized contaminants from the reactor;

combining a fluid with the dry cuttings to produce a slurry;

transferring the slurry to a storage vessel; and transferring the slurry from the storage vessel to a cuttings re-injection system.

11. A system for offshore treatment of drill cuttings, comprising:

a first pressurized vessel configured to receive contaminated drill cuttings and adapted to allow a compressed gas be introduced therein as the sole means for inducing movement of said contaminated drill cuttings in the first pressurized vessel, whereby at least a portion of the contaminated drill cuttings is discharged from the first pressurized vessel; and a reactor unit in fluid connection with the first pressurized vessel for separating the contaminated drill cuttings into drill cuttings and contaminants, comprising:

a processing chamber having at least one inlet and outlet;

a rotor mounted in the processing chamber, comprising:

a shaft; and a plurality of fixed rotor arms extending radially from the shaft a first pump;

a first transfer line fluidly connecting the reactor unit and the pump, the transfer line comprising:

a fluid inlet for receiving a fluid;

a storage vessel fluidly connected to the pump for storing a slurry;

a second pump; and a second transfer line fluidly connecting the storage vessel to a wellbore.

12. The system of claim 11, wherein the system further comprises:

a programmable logic controller.

13. A system for offshore disposal of drill cuttings, comprising:

a cleaning system for treating contaminated drill cuttings into drill cuttings and contaminants;

a transport system for moving the drill cuttings;

a slurrification system for making a slurry of the treated drill cuttings; and a cuttings re-injection system for injecting the slurry into a well, wherein the slurrification system comprises a classification system, wherein the transport system comprises a pneumatic transfer system comprising a first pressurized vessel configured to receive contaminated drill cuttings and adapted to allow a compressed gas be introduced therein as the sole means for inducing movement of said contaminated drill cuttings in the first pressurized vessel and a second pressurized vessel in fluid communication with the first pressurized vessel configured to receive the contaminated drill cuttings from a separation means and deliver the contaminated drill cuttings to the first pressurized vessel.

14. The system of claim 13, wherein the cleaning system comprises a hammermill.

15. The system of claim 13, wherein the slurrification system comprises a tank and a pump.

16. The system of claim 13, wherein the cuttings re-injection system comprises a high pressure pump.

17. The system of claim 13, wherein the system further comprises:

a programmable logic controller.

18. The system of claim 13, wherein the cleaning system_comprises a reactor unit in fluid connection with the transport system for separating the contaminated drill cuttings into drill cuttings and contaminants, comprising:

a processing chamber having at least one inlet and outlet; and a rotor mounted in the processing chamber, comprising:

a shaft; and a plurality of fixed rotor arms extending radially from the shaft.

19. The system of claim 13, wherein the classification system determines the size range of the slurry based on diameter.

* * * * *